US010669615B2

(12) United States Patent
Wiesner

(10) Patent No.: US 10,669,615 B2
(45) Date of Patent: Jun. 2, 2020

(54) ALLOY FOR PRESSURE DIE-CASTING

(71) Applicant: Rheinfelden Alloys GmbH & Co. KG, Rheinfelden (DE)

(72) Inventor: Stuart Wiesner, Rheinfelden (CH)

(73) Assignee: Rheinfelden Alloys GmbH & Co. KG (DE)

( * ) Notice: Subject to any disclaimer, the term of this patent is extended or adjusted under 35 U.S.C. 154(b) by 0 days.

(21) Appl. No.: 16/094,309

(22) PCT Filed: May 2, 2016

(86) PCT No.: PCT/EP2016/059722

§ 371 (c)(1),
(2) Date: Oct. 17, 2018

(87) PCT Pub. No.: WO2017/182101

PCT Pub. Date: Oct. 26, 2017

(65) Prior Publication Data

US 2019/0136350 A1 May 9, 2019

(30) Foreign Application Priority Data

Apr. 19, 2016 (EP) ..... 16165977

(51) Int. Cl.

| | |
|---|---|
| ***C22C 21/08*** | (2006.01) |
| ***C22F 1/047*** | (2006.01) |
| ***C22F 1/05*** | (2006.01) |
| ***B22D 21/00*** | (2006.01) |

(52) U.S. Cl.
CPC ..... *C22C 21/08* (2013.01); *B22D 21/007* (2013.01); *C22F 1/047* (2013.01); *C22F 1/05* (2013.01)

(58) Field of Classification Search
CPC ..... C22C 21/08; C22F 1/047
See application file for complete search history.

(56) References Cited

U.S. PATENT DOCUMENTS

| | | | | |
|---|---|---|---|---|
| 2006/0169371 | A1* | 8/2006 | Cosse | C22C 21/08 148/439 |
| 2007/0240796 | A1* | 10/2007 | Koch | C22C 21/08 148/688 |
| 2009/0214381 | A1 | 8/2009 | Trenda et al. | |
| 2010/0074796 | A1* | 3/2010 | Franke | C22F 1/05 420/535 |

FOREIGN PATENT DOCUMENTS

| | | | |
|---|---|---|---|
| DE | 10352932 | A1 | 6/2005 |
| EP | 0853133 | B1 | 5/2001 |
| WO | 2006122341 | A2 | 11/2006 |

* cited by examiner

*Primary Examiner* — George Wyszomierski
*Assistant Examiner* — Janell C Morillo
(74) *Attorney, Agent, or Firm* — The Webb Law Firm

(57) ABSTRACT

An aluminium, magnesium and silicon-based die casting alloy having 5.0-7.0 wt. % magnesium, 1.5-7.0 wt. % silicon, 0.3-0.8 wt. % manganese, 0.03-0.5 wt. % iron, 0.01-0.4 wt. % molybdenum, 0.01-0.3 wt. % zirconium, 0-0.25 wt. % titanium, 0-0.25 wt. % strontium, 0-250 ppm phosphorus, 0-4 wt. % copper and 1-10 wt. % zinc, the remainder being aluminium and inevitable impurities.

13 Claims, No Drawings

ALLOY FOR PRESSURE DIE-CASTING

CROSS-REFERENCE TO RELATED APPLICATIONS

This application is the United States national phase of International Application No. PCT/EP2016/059722 filed May 2, 2016, and claims priority to European Patent Application No. 16165977.6 filed Apr. 19, 2016, the disclosures of which are hereby incorporated in their entirety by reference.

BACKGROUND OF THE INVENTION

Field of the Invention

The invention relates to a pressure die-casting alloy based on aluminium, magnesium and silicon, especially for use in lightweight automotive structural components.

Description of Related Art

As representative of pressure die-casting alloys based on aluminium, magnesium and silicon and known from prior art, two alloys developed by the applicants should be mentioned, that disclosed in EP 0853133 B1 and that disclosed in DE 10352932 B4.

DE 10352932 B4 describes an aluminium alloy that is thermally stable up to 400° C., which, in addition to the use of known alloying elements, includes the addition of scandium. A number of additional elements such as titanium and zirconium have been tested in conjunction with scandium in order to further increase the high-temperature strength of the alloy.

The alloy disclosed in EP 0853133 B1 is an aluminium, magnesium, silicon alloy which is comparable to the reference alloy mentioned in the illustrative embodiments. This alloy has been produced by the applicant and used in the automotive industry for several years.

In binary AlMg alloys, the $Mg_2Al_3$ eutectic point lies at approx. 35% Mg. In the case of the alloy according to the present invention and also in the alloy according to EP 0853133B1, however, there is a $Mg_2Si$ eutectic which makes up approx. 50% of the microstructure of the die-casting. In this way it differs fundamentally from binary AlMg alloys.

An additional alloy composition representative of the prior art regarding the alloy according to the present invention is Hydroalium. This is an alloy based on aluminium and magnesium which is used for cylinder heads, among other applications.

SUMMARY OF THE INVENTION

Starting from the experience of the applicant with the alloy disclosed in EP 0853133 B1, the object was to increase the strength properties of this alloy, without compromising the elongation characteristics.

An additional object is to develop a high-strength aluminium pressure die-casting alloy with the above-mentioned properties, where the aluminium base of the alloy may contain at least 50% of secondary metal (recycled material).

The alloy according to the present invention is intended to meet the ever more demanding requirements for lightweight construction in the automotive industry. Use of a material with higher strength allows the designer to achieve structures with thinner walls and thus lower weight. This represents a further step toward reducing fuel consumption in automobiles.

The alloy according to the present invention is in principle versatile, but is envisioned for use in structural components of automobiles. It can be used for production of crash-relevant structural components, for which a Cu- and Zn-free variant entirely without or with a T5 heat treatment is likely to be selected.

A further area of application includes battery-supporting structures in the area of E-mobility. In this application, there is a search for high-strength materials in order to save weight. The riveting capability of the material is less important in this field of use, since the components are deinstallable and thus screwed in. Also of secondary relevance, compared to crash-relevant components, is the deformability of the material. Accordingly, in this field of use, an alloy variant with copper (Cu) or zinc (Zn) is used that is already suitable in the as-cast condition or after undergoing heat treatment.

In accordance with the present invention, the objects mentioned are achieved by a pressure die-casting alloy based on aluminium-magnesium-silicon, comprising or consisting of:

| | | |
|---|---|---|
| magnesium (Mg) | 5.0-7.0% | by weight |
| silicon (Si) | 1.5-4.0% | by weight |
| iron (Fe) | 0.03-0.5% | by weight |
| manganese (Mn) | 0.3-0.8% | by weight |
| zirconium (Zr) | 0.01-0.4% | by weight |
| molybdenum (Mo) | 0.01-0.4% | by weight |
| vanadium(V) | 0.01-0.03% | by weight |
| beryllium (Be) | 0.001-0.005% | by weight |
| titanium (Ti) | 0-0.15% | by weight |
| strontium (Sr) | 0-0.1% | by weight |
| phosphorus (P) | 0-250 | ppm |
| copper (Cu) | 0-4% | by weight |
| zinc (Zn) | 0-10% | by weight |

In one embodiment, the alloy according to the present invention comprises 0.05 to 0.20% by weight molybdenum.

In a further embodiment, the alloy according to the present invention comprises 0.05 to 0.20% by weight zirconium.

In a further embodiment, the alloy according to the present invention comprises 2.0 to 3.0% by weight silicon.

In a further embodiment, the alloy according to the present invention comprises 5.5 to 6.5% by weight magnesium.

In a further embodiment, the alloy according to the present invention comprises 0-0.08% by weight titanium.

In a further embodiment, the alloy according to the present invention comprises 0.05 to 0.2% by weight iron.

In a further embodiment, the alloy according to the present invention comprises 0-0.2 wt. % copper.

In a further embodiment, the alloy according to the present invention comprises 0-0.5% by weight zinc.

In a further embodiment, the alloy according to the present invention comprises 0-0.01% by weight strontium.

Preferably, structural components are die-cast under pressure from the alloy according to the present invention.

DESCRIPTION OF THE INVENTION

The present invention is directed to an alloy for pressure die casting comprising or consisting of: magnesium 5.0-7.0% by weight, silicon 1.5-4.0% by weight, iron 0.03-0.5% by weight, manganese 0.3-0.8% by weight, zirconium 0.01-0.4% by weight, molybdenum 0.01-0.4% by weight, vanadium 0.01-0.03% by weight, beryllium 0.001-0.005% by weight, titanium 0-0.15% by weight, strontium 0-0.1% by weight, phosphorus 0-250 ppm, copper 0-4% by weight, zinc 0-10% by weight and the remainder being aluminium and unavoidable impurities.

Initially, the Mg and Si contents were varied to find an MgSi ratio suitable for the more demanding requirements. Increasing the Mg provided a strength increase, but starting at 6.5% a noticeable reduction in the elongation at break had to be taken into account. The additional increase in Si resulted in an increase of the eutectic fraction of the alloy, which did not yield any technical benefits. Over and above a Mg:Si ratio of 2:1 there is a significant loss in elongation at break.

It is known that the solubility of $Mg_2Si$ decreases with increasing Mg content. Moreover, during slow solidification, coarse-grained $Mg_2Si$ particles form that have an adverse effect on mechanical properties. These relationships were confirmed in the present investigations.

It is also known that there is a change in the eutectic phase function up to a silicon content of 2.5%, but no change in the solidification temperature. This relationship is used in the alloy according to the present invention.

It is known that the $Mg_2Si$ which accumulates at the grain boundaries results in worsening of the corrosion behaviour. Since the alloy according to the present invention is used in pressure die-casting, rapid solidification occurs, which greatly reduces grain boundary segregation to a corresponding degree and in this way compensates for this adverse effect.

Starting from an optimized MgSi ratio, a series of additional elements was added, among them Cu, Zn, Mo, Zr, V and Ti.

Titanium and zirconium are known as grain refiners. On the whole, the interplay of the elements mentioned represents an important basis for the alloy according to the present invention.

On addition of the elements Zn and Cu, high yield strengths of over 400 MPa can be achieved, especially after heat treatment, but at quite low elongation values of 4-5%.

It was determined that, compared to the comparative alloy from EP 0 853 133B1, the strength-increasing effect resulted especially from high-melting-point phases formed by the elements Mo and Zr in conjunction with V and Ti. On the one hand, separation of these phases from the melt is to be avoided, during production of the alloy as well as during the casting process. On the other hand, they should solidify first during casting in order to achieve a fine microstructure in this way and good mechanical properties as a result. Preferably, the titanium content should be maintained between 0-0.08% by weight.

The alloy according to the present invention has been developed primarily for pressure die-casting and the typical solidification conditions encountered there. The size and extent of high-melting-point phases always depends on the solidification conditions. During pressure die-casting, solidification usually already begins in the shot chamber, continues during filling of the die and ends in thick-walled regions, frequently only after removal of the part.

To further increase the strength of the alloy according to the present invention without large losses in the elongation values, a T5 heat treatment is included.

If Cu and Zn are also added to the alloy according to the present invention, a T6 or a T7 heat treatment is included. Compared to the reference alloy from EP 0 853 133B1, a definite increase in strength and yield point could be achieved in this case, but with a noticeable reduction in the elongation at break.

One embodiment of the alloy according to the present invention includes the addition of secondary aluminium in the form of recycled material. Preferably, the amount of secondary aluminium should account for 50% of the aluminium base alloy needed for production of the alloy. The term recycled material should be understood to mean, for instance: wheels, extruded profiles, sheet and metal chips of aluminium alloys. With the alloy composition according to the present invention, it is possible, up to an iron content of 0.20% by weight, to meet the requirements for crash-relevant structural components; over 0.20% by weight iron allows use in the area of strength-relevant structural components.

The slight increase in iron content is addressed by reducing the manganese fraction. The risk of sludge forming in the holding furnace of the casting machine can be mitigated in this way.

The tendency of the alloy to stick in the casting die drops nevertheless, as both iron and manganese act beneficially in this regard and the reduction in Mn is more than compensated by the Fe content. Furthermore, the MnFe ratio prevents the formation of so-called beta phases, i.e. platelet-shaped AlMnFeSi precipitates that crucially reduce the ductility of the material. Such precipitates can be seen under the microscope as so-called iron needles.

A cyclic salt spray test (ISO 9227) and an intercrystalline corrosion test (ASTM G110-92) were used to check the corrosion tendency. The composition of the alloy according to the present invention has been selected so that in the case of the low-Cu and low-Zn variant very good corrosion resistance can be detected.

In punch riveting tests, the alloy according to the present invention could be riveted without cracking despite its high strength.

EXAMPLES

The compositions of a comparable alloy as disclosed in EP 0 853 133B1 (Alloy 1) and three illustrative embodiments (Alloys A, B and C) of the alloy according to the present invention are compared hereinafter. The data are presented as % by weight. Using these three alloys, the mechanical characteristics ($R_m$, $Rp_{0.2}$ and $A_5$) were measured on pressure die-cast 3 mm plates. The mean value from 8 tensile tests is presented. The results were determined in the cast state (State F), in the T5 state (controlled cooling with subsequent artificial aging) and in the T6 state (solution annealing with full artificial aging).

| | Mg | Si | Mn | Fe | Cu | Zn |
|---|---|---|---|---|---|---|
| Alloy 1 | 5.79 | 2.34 | 0.66 | 0.09 | 0.001 | 0.01 |
| Alloy A | 6.31 | 2.50 | 0.69 | 0.10 | 0.002 | 0.00 |
| Alloy B | 6.21 | 2.61 | 0.46 | 0.19 | 0.02 | 0.03 |
| Alloy C | 5.25 | 2.19 | 0.64 | 0.10 | 0.20 | 5.62 |

| | Ti | V | Be | Zr | Mo | P |
|---|---|---|---|---|---|---|
| Alloy 1 | 0.083 | 0.028 | 0.0027 | 0.000 | 0.000 | 0.0002 |
| Alloy A | 0.006 | 0.013 | 0.0028 | 0.081 | 0.050 | 0.0002 |
| Alloy B | 0.004 | 0.015 | 0.0023 | 0.100 | 0.068 | 0.0002 |
| Alloy C | 0.150 | 0.022 | 0.0004 | 0.001 | 0.001 | 0.0004 |

Results Achieved

| | Rm [N/mm$^2$] | $RP_{0.2}$ [N/mm$^2$] | $A_5$ [%] |
|---|---|---|---|
| F state | | | |
| Alloy 1 | 315 | 179 | 11.5 |
| Alloy A | 355 | 213 | 10.7 |
| Alloy B | 342 | 209 | 9.2 |
| Alloy C | 375 | 265 | 4.9 |
| T5 state | | | |
| Alloy 1 | 313 | 213 | 9.0 |
| Alloy A | 370 | 236 | 10.1 |
| Alloy B | 354 | 232 | 8.5 |
| Alloy C | 370 | 279 | 3.4 |
| T6 state | | | |
| Alloy 1 | 292 | 186 | 9.0 |
| Alloy C | 429 | 363 | 4.4 |

The invention claimed is:

1. An aluminium-magnesium-silicon-based alloy for pressure die casting, consisting of:

| | |
|---|---|
| magnesium | 5.0-7.0% by weight |
| silicon | 1.5-4.0% by weight |
| iron | 0.03-0.5% by weight |
| manganese | 0.3-0.8% by weight |
| zirconium | 0.01-0.4% by weight |
| molybdenum | 0.01-0.4% by weight |
| vanadium | 0.01-0.03% by weight |
| beryllium | 0.001-0.005% by weight |
| titanium | 0-0.15% by weight |

-continued

| | |
|---|---|
| strontium | 0-0.1% by weight |
| phosphorus | 0-250 ppm |
| copper | 0-4% by weight |
| zinc | 0-10% by weight |

the remainder being aluminium and unavoidable impurities.

2. The alloy for pressure die casting according to claim 1, wherein molybdenum is 0.05 to 0.20% by weight.

3. The alloy for pressure die casting according to claim 1, wherein zirconium is 0.05 to 0.20% by weight.

4. The alloy for pressure die casting according to claim 1, wherein silicon is 2.0 to 3.0% by weight.

5. The alloy for pressure die casting according to claim 1, wherein magnesium is 5.5 to 6.5% by weight.

6. The alloy for pressure die casting according to claim 1, wherein titanium is 0-0.08% by weight.

7. The alloy for pressure die casting according to claim 1, wherein iron is 0.05 to 0.2% by weight.

8. The alloy for pressure die casting according to claim 1, wherein copper is 0-0.2% by weight.

9. The alloy for pressure die casting according to claim 1, wherein zinc is 0-0.5% by weight.

10. The alloy for pressure die casting according to claim 1, wherein strontium is 0-0.01% by weight.

11. A structural component comprising an alloy for pressure die casting according to claim 1.

12. The alloy for pressure die casting according to claim 1, wherein magnesium is 5.0-6.21% by weight.

13. The alloy for pressure die casting according to claim 1, wherein silicon is 1.5-2.61% by weight.

* * * * *